US011214423B2

(12) United States Patent
Gaylor et al.

(10) Patent No.: US 11,214,423 B2
(45) Date of Patent: Jan. 4, 2022

(54) CARTON WITH INTEGRATED HANDLE ASSEMBLY

(71) Applicant: General Mills, Inc., Minneapolis, MN (US)

(72) Inventors: Aaron Gaylor, Oak Grove, MN (US); Todd Jensen, Bloomington, MN (US)

(73) Assignee: General Mills, Inc., Minneapolis, MN (US)

( * ) Notice: Subject to any disclaimer, the term of this patent is extended or adjusted under 35 U.S.C. 154(b) by 406 days.

(21) Appl. No.: 15/869,778

(22) Filed: Jan. 12, 2018

(65) Prior Publication Data

US 2018/0208383 A1 Jul. 26, 2018

Related U.S. Application Data

(60) Provisional application No. 62/450,872, filed on Jan. 26, 2017.

(51) Int. Cl.
*B65D 5/54* (2006.01)
*B65D 25/30* (2006.01)
(Continued)

(52) U.S. Cl.
CPC ..... *B65D 77/02* (2013.01); *B65D 5/4608* (2013.01); *B65D 5/54* (2013.01); *B65D 5/544* (2013.01);
(Continued)

(58) Field of Classification Search
CPC ..... B65D 77/02; B65D 5/54; B65D 5/4608; B65D 5/541; B65D 5/5415; B65D 5/542; B65D 5/5425; B65D 5/543; B65D 5/5435; B65D 5/544; B65D 5/5445; B65D 5/545; B65D 5/5455; B65D 5/546; B65D 5/5465; B65D 5/547; B65D 5/5475; B65D 5/548;
(Continued)

(56) References Cited

U.S. PATENT DOCUMENTS 2,069,997 A * 2/1937 Carr ..... B65D 5/4608 206/169
2,557,914 A 6/1951 Miller
(Continued)

FOREIGN PATENT DOCUMENTS

GB 2186550 8/1987
GB 2497720 6/2013
(Continued)

*Primary Examiner* — Ericson M Lachica
(74) *Attorney, Agent, or Firm* — Diederiks & Whitelaw, PLC; Annette M. Frawley, Esq.

(57) ABSTRACT

A carton for storing a plurality of products includes a main body establishing an enclosure with an interior cavity for storing a plurality of products, with the enclosure being formed from a plurality of interconnected panels. A hingedly connected access flap, enabling access to the interior cavity, is formed from and extends across portions of at least two of the plurality of panels. The carton is provided with a handle assembly established, at least in part, by first and second openings, with the first opening being formed in the access flap and the second opening being formed adjacent the access flap in one of the plurality of panels. The handle assembly enables the carton to be readily grasped with one hand while simultaneously closing an access opening to the carton with the flap.

18 Claims, 4 Drawing Sheets

(51) Int. Cl.
*B65D 77/02* (2006.01)
*B65D 5/468* (2006.01)

(52) U.S. Cl.
CPC ..... *B65D 5/547* (2013.01); *B65D 5/549* (2013.01); *B65D 25/30* (2013.01)

(58) Field of Classification Search
CPC .... B65D 5/5485; B65D 5/549; B65D 5/5495; B65D 5/6623; B65D 5/6644; B65D 5/70; B65D 5/701; B65D 5/703; B65D 5/705; B65D 5/706; B65D 25/30; B65D 71/38; B65D 5/468; B65D 5/56; B65D 5/66; B65D 43/16; B65D 85/10; B65D 25/28; B65B 43/08; B65B 43/10; B65B 1/02
See application file for complete search history.

(56) References Cited

U.S. PATENT DOCUMENTS 3,119,544 A * 1/1964 Cope ..... B65D 5/4608 229/117.16
3,881,648 A * 5/1975 Hall ..... B65D 5/2047 229/112
3,952,940 A * 4/1976 Malcolm ..... B65D 5/4608 229/117.31
4,318,474 A 3/1982 Hasegawa
4,909,395 A 3/1990 Weissman
5,240,176 A * 8/1993 Akers ..... B65D 5/4608 206/366
5,584,430 A * 12/1996 Mulry ..... B65D 5/4608 229/117.13
5,680,986 A 10/1997 Botterman
6,425,520 B1 7/2002 Peterson
6,918,487 B2 7/2005 Harrelson
8,186,569 B2 5/2012 Kelly
8,328,079 B2 12/2012 Kohler
8,646,654 B2 2/2014 Miller
D719,018 S 12/2014 Levy et al.
2004/0031706 A1* 2/2004 Stringfield ..... B65D 5/6602 206/268
2004/0188508 A1 9/2004 Holley, Jr. et al.
2005/0178687 A1 8/2005 Spivey, Sr.
2005/0189405 A1 9/2005 Gomes et al.
2006/0175386 A1 8/2006 Holley, Jr.
2006/0249529 A1 11/2006 Smalley et al.
2007/0057029 A1 3/2007 Harrelson
2008/0237324 A1* 10/2008 Walling ..... B65D 5/0227 229/117.17
2010/0102112 A1* 4/2010 Ouillette ..... B65D 5/46016 229/117.32
2011/0233091 A1 9/2011 Block et al.
2011/0233268 A1* 9/2011 Kelly ..... B65D 5/4608 229/240
2013/0312369 A1* 11/2013 Maki ..... B65D 5/542 53/456
2014/0332427 A1 11/2014 Holley, Jr.
2016/0194106 A1 7/2016 Walling et al.

FOREIGN PATENT DOCUMENTS

JP 2004345683 12/2004
JP 2009023672 2/2009

* cited by examiner

CARTON WITH INTEGRATED HANDLE ASSEMBLY

CROSS-REFERENCE TO RELATED APPLICATIONS

The present application claims the benefit of U.S. Provisional Application Ser. No. 62/450,872 filed Jan. 26, 2017 entitled "Carton with Integrated Handle Assembly". The content of this application is incorporated herein by reference.

FIELD OF THE INVENTION

The invention generally pertains to packaging products, particular food products, in cartons and, more specifically, to a paperboard or corrugated material carton including an access flap which extends into multiple sides of the carton and an integrated handle assembly including multiple, spaced openings with one of the openings being in the flap.

BACKGROUND OF THE INVENTION

In connection with shipping various types of products, such as food products, from a manufacturer to a retail establishment, it is known to initially package the products in cartons. Although various materials could be used in making the cartons, the most common material employed is paperboard. In general, the paperboard is provided in the form of a blank which can be conveniently stored in a flat configuration or side seamed configuration but easily erected through a simple folding operation to establish a carton which can be filled with various food products and sealed, typically in an automated process, and then shipped through designated distribution channels to retail establishments, such as grocery or wholesale stores.

Cartons of this type are known to provide for selling products, such as snack food products like breakfast bars, in bulk, with the carton functioning, after being sold, to store the various products for selective dispensing. For instance, the carton can be placed in a household pantry and opened to provide selective access to the stored products.

In connection with the invention, it is desired to provide a carton of this type with both a handle assembly to enhance the ability of the carton to be grasped for transportation and positioning purposes and also a flap which can be selectively shifted between a closed position to prevent products from falling out during repositioning of the carton and an opened position wherein the internally stored products can be readily accessed and removed from the carton.

SUMMARY OF THE INVENTION

In connection with certain aspects of the invention, a carton, preferably made of paperboard or corrugated material like cardboard, is formed with a flap that is created from portions of multiple sides of the carton and remains connected to the remainder of a body of the carton by a living hinge. In this manner, the flap can be readily pivoted from a closed position to a retracted or opened position to establish an enlarged access opening, enabling products stored in the carton to be readily accessed. The extent of the flap enables the carton to be selectively supported in either vertical or horizontal configurations while still providing ready access to the stored products. In connection with another aspect of the invention, the carton includes a handle assembly, established by a first opening formed directly adjacent a free end portion of the hinged flap and a second opening formed in a side panel of the carton at a position spaced or offset from the flap. With this arrangement, the carton can be initially transported or subsequently repositioned, even after the flap has been opened, by placing one or more fingers of a person's hand in the first opening formed in the flap and one or more other fingers of the same hand in the second opening in order to securely grasp the carton.

In accordance with a preferred form of the invention, a free end portion of the flap is defined by a portion of one carton side panel and the flap extends into an end panel of the carton where the living hinge is established. In one embodiment of the invention, the handle assembly is established by a thumb receiving hole provided in the free end portion of the flap and an elongated, transversely extending slotted opening, which is formed in the same carton side panel directly adjacent the free end portion of the flap and adapted to receive the remaining fingers of a user's hand for grasping the carton. In another embodiment, the thumb hole and slotted hole are reversed. In a still further embodiment, one of the holes is provided in the free end portion of the flap and the other hole is provide in another carton side panel such that, when grasping the carton through the use of the two holes with a user's hand, the hand extends around a corner portion of the carton.

Additional objects, features and advantages of the invention will become more readily apparent from the following detailed description when taken in conjunction with the drawings wherein like reference numerals refer to corresponding parts in the several views.

DETAILED DESCRIPTION OF THE INVENTION

Figure 1:
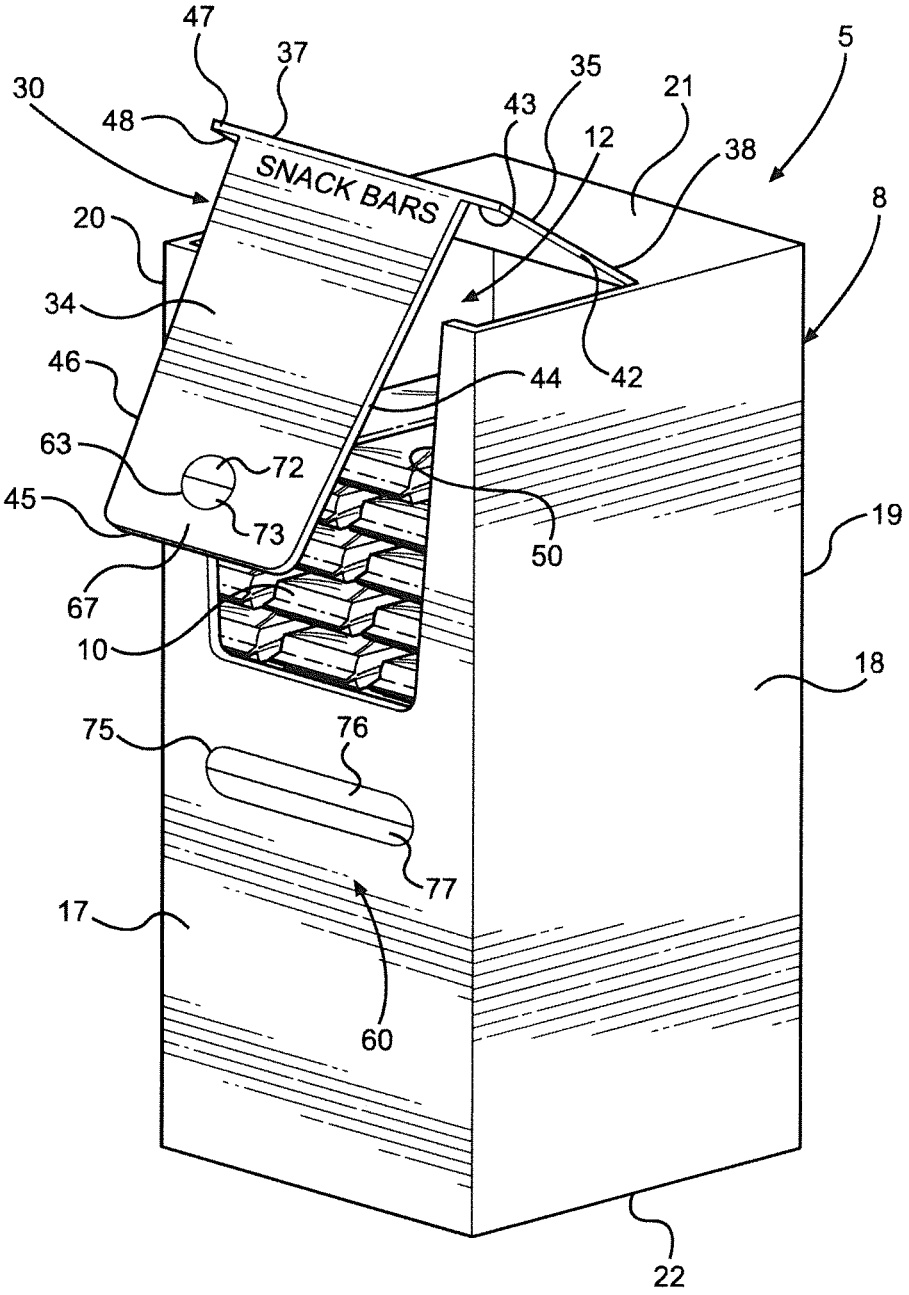
FIG. 1 is a perspective view of a carton fainted with an access flap and handle assembly in accordance with a first embodiment of the invention.

Initially, it should be noted that the use of terms, such as upper, lower, front, rear, top, bottom and the like, herein is for reference purposes only in describing exemplary forms of the invention as set forth below and illustrated in the drawings. Therefore, these terms should not be considered limiting as to the overall invention.

With initial reference to FIG. 1, a carton constructed in accordance with the present invention is generally indicated at 5. In accordance with the invention, carton 5 can be made of various materials, particularly paperboard or corrugated material like cardboard, and used to store a variety of products 10, such as individually wrapped snack food products, which are stored in carton 5 until selectively accessed. As will be detailed more fully below, carton 5 can be supported in various orientations and is specifically designed with a handle assembly which enables carton 5 to be easily repositioned or transported in a manner which assures that the stored products cannot fall out an access opening of the carton.

In accordance with the preferred embodiment shown, carton 5 is defined by a main body 8 which establishes an enclosure for storing products 10 within an interior cavity 12 thereof. Main body 8 is formed form a plurality of interconnected side panels 17-22, with side panels 21 and 22 being depicted as establishing end panels. Carton 5 also includes an access flap 30 for exposing interior cavity 12. As clearly shown in the figures, access flap 30 extends across portions of at least two of the side panels 17-22. More specifically, referring back to the embodiment of FIG. 1, access flap 30 includes a first portion 34 which is formed from a portion of side panel 17 and a second portion 35 formed from a portion of end panel 21. As will be detailed more fully below, first portion 34 is connected to second portion 35 along a fold line 37 and second portion 35 is hinged to the remainder of end panel 21, preferably through a living hinge indicated at 38. Overall, access flap 30 includes edge portions 42-48, each of which formed part of a respective perforated tear line with other portion of main body 8. In this manner, access flap 30 establishes part of the enclosure encapsulating the various products 10 and then can be readily detached along the perforations associated with edge portions 42-48 and shifted, particularly based on the inclusion of hinge 38, to establish an access opening 50 and enable selective access to products 10 within interior cavity 12. At this point, it should also be noted that the connection defining hinge 38 could also be perforated to enable access flap 30 to be completely removed if desired by a consumer.

Figure 2:
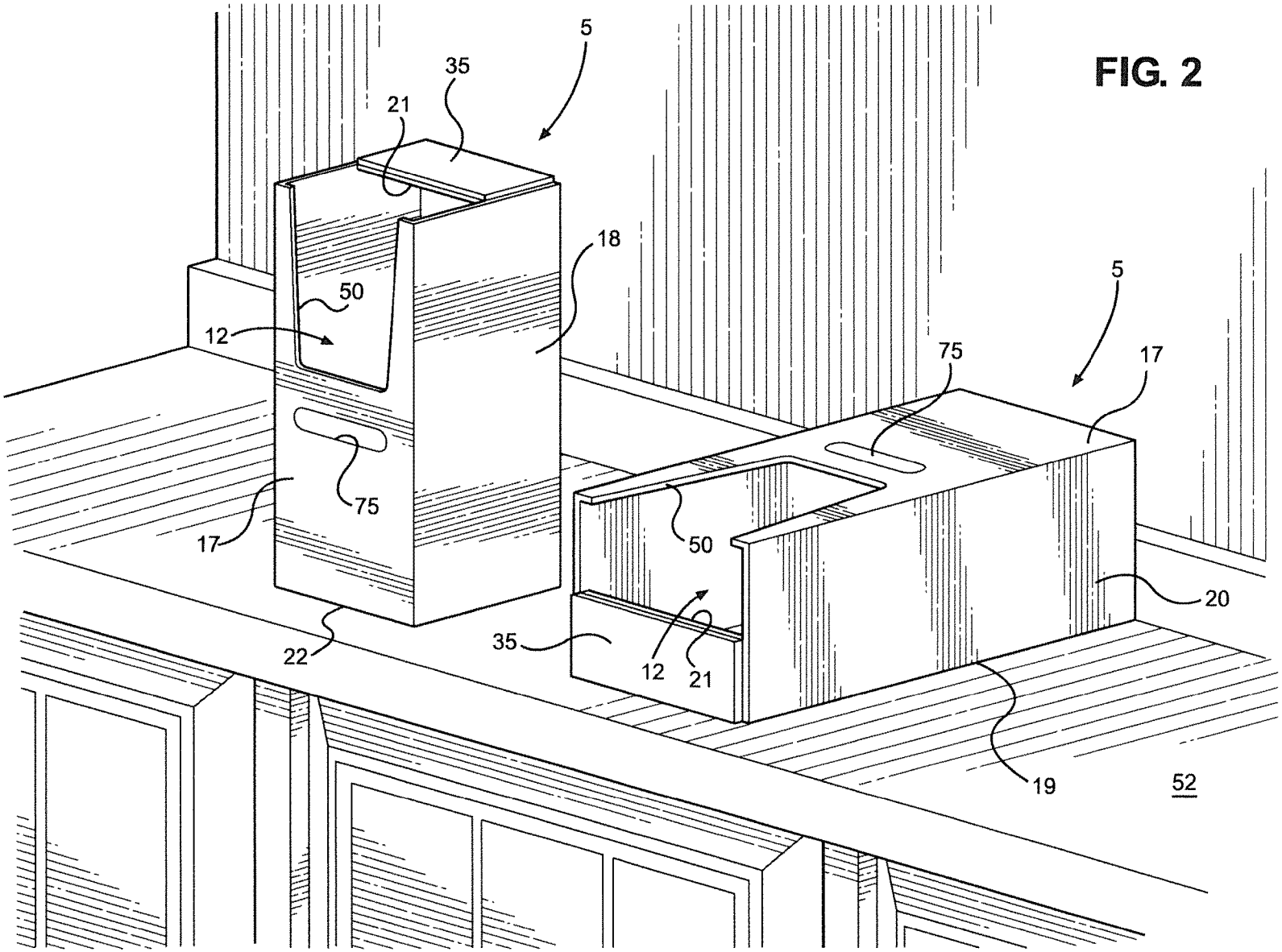
FIG. 2 illustrates two cartons constructed in the manner shown in FIG. 1, with one of the cartons being supported in a vertical orientation and the other carton being supported in a horizontal orientation.

Given its construction, carton 5 can be conveniently supported in multiple positions. FIG. 2 illustrates two particularly convenient support configurations. That is, the left side of this figure shows carton 5 supported in a generally upright position as end panel 22 rests directly on a supporting surface 52, such as a kitchen countertop or pantry shelf, while the right side of the figure shows side panel 19 of carton 5 resting directly on supporting surface 52. In both arrangements, access flap 30 is folded back such that second portion 35 extends along part of side panel 21 and first portion 34 extends along part of side panel 19. Based thereon, it should be clear that hinge 38 has provided for near 180° pivoting of access flap 30 and first portion 34 has been rotated about fold line 37 through 90° relative to hinge 38. However, as indicated above, access flap 30 could also be completely removed, such as by including perforations along the connection defining hinge 38. In addition, given the particularly advantageous sizing for second portion 35 relative to an overall dimension of side panel 21, i.e., second portion 35 being essentially half of the total dimension of side panel 21 between side panels 17 and 19, first portion 34 will extend along side panel 19 such that access flap 30 can be conveniently repositioned to enable unobstructed access to interior cavity 12.

Also important in connection with the present invention is the inclusion of a handle assembly which is generally indicated at 60 in the figures. As will be detailed more fully below, various different handle arrangements are disclosed, with each handle assembly 60 including an opening in first portion 34 of access flap 30 and another opening in one of side panels 17, 18 or 20, with the two openings being used in tandem to enable both the closing of the access opening 50 established by access flap 30 and the secure grasping of carton 5 by a single hand of a user.

Figure 3:
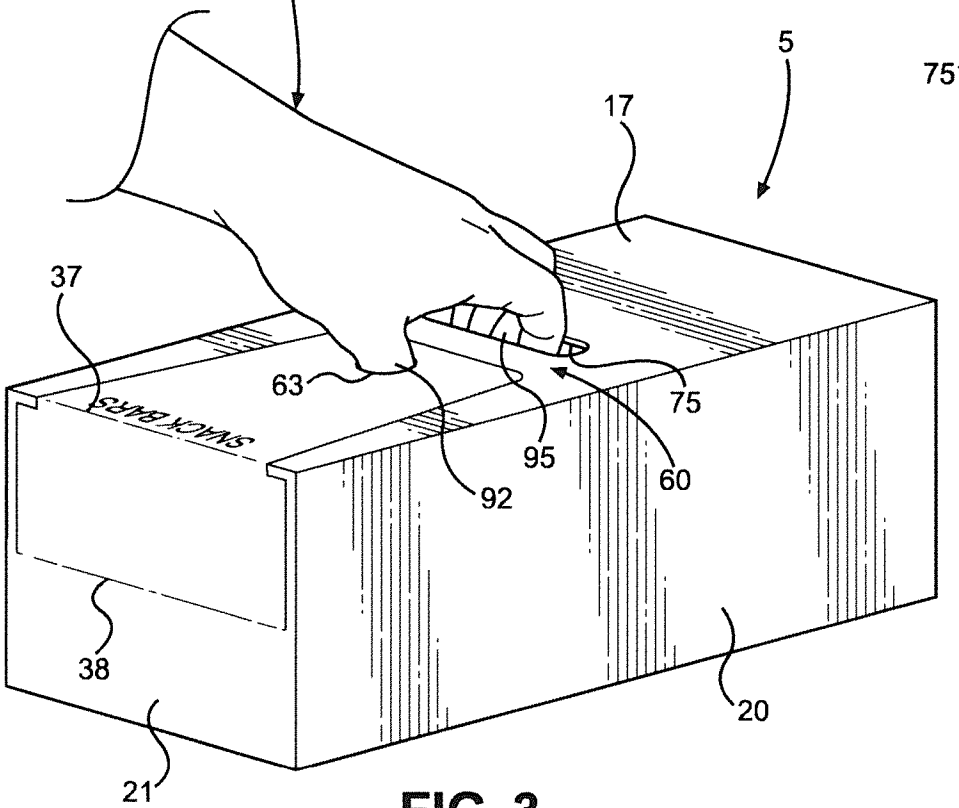
FIG. 3 is a perspective view of the carton of FIG. 1 being grasped through use of the handle assembly.

With initial reference to the arrangement of FIGS. 1-3, handle assembly 60 includes a first opening 63 formed in a terminal end portion 67 of first portion 34 of access flap 30, adjacent but spaced from edge portion 45. In FIG. 1, first opening 63 is formed by punch-out tabs 72 and 73 which create a substantially circular opening. In addition, handle assembly 60 includes a second opening 75 formed by punch-out tabs 76 and 77 formed in side panel 17 at a position adjacent but spaced from access opening 50. In the preferred embodiment shown, second opening 75 is an elongated, generally elliptical opening. As perhaps best shown in FIG. 3, this arrangement enables a user to both retain access flap 30 in a closed position and securely grasp carton 5 for transport or other purposes, all with a single hand 90. More specifically, a user can position access flap 30 at opening 50, place a thumb 92 of hand 90 in first opening 63 and place multiple additional fingers 95 of hand 90 in second opening 75 to securely grasp carton 5. With both first and second openings 63 and 75 being provided along a common side of carton 5 and spaced a distance generally in the order of 4-5 inches (approximately 10-13 cm) center-to-center, carton 5 can be easily repositioned without fear of any products 10 falling out of interior cavity 12.

Figure 4:
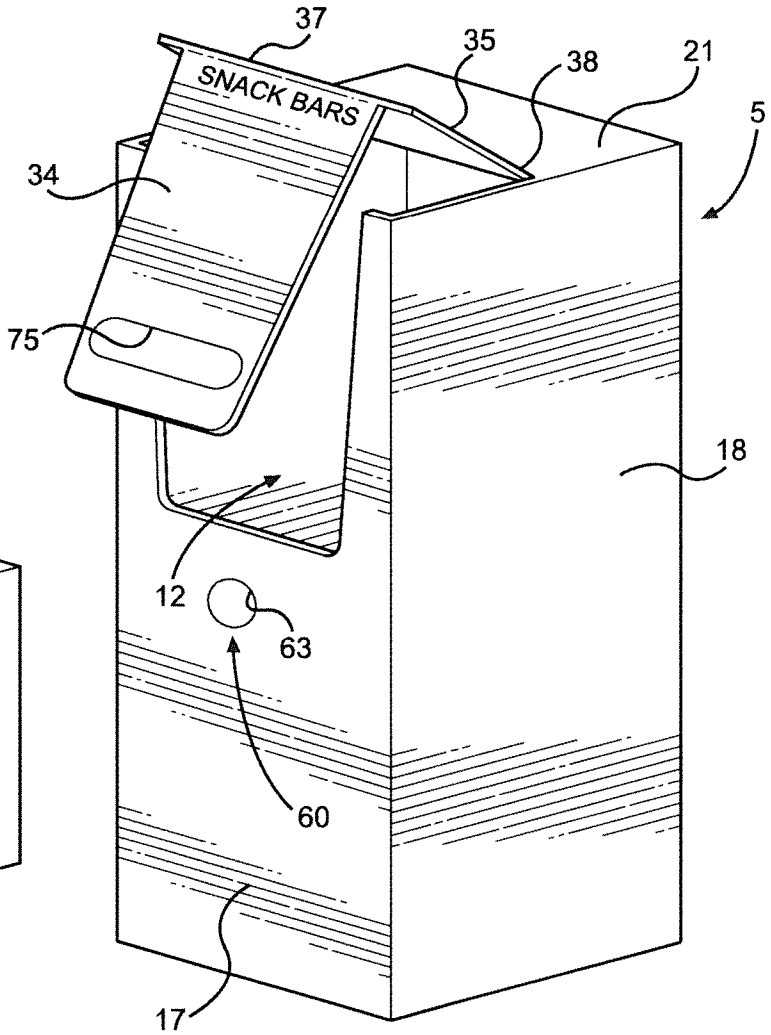
FIG. 4 is a perspective view similar to that of FIG. 1 but wherein openings of the handle assembly are reverse.
Figure 5:
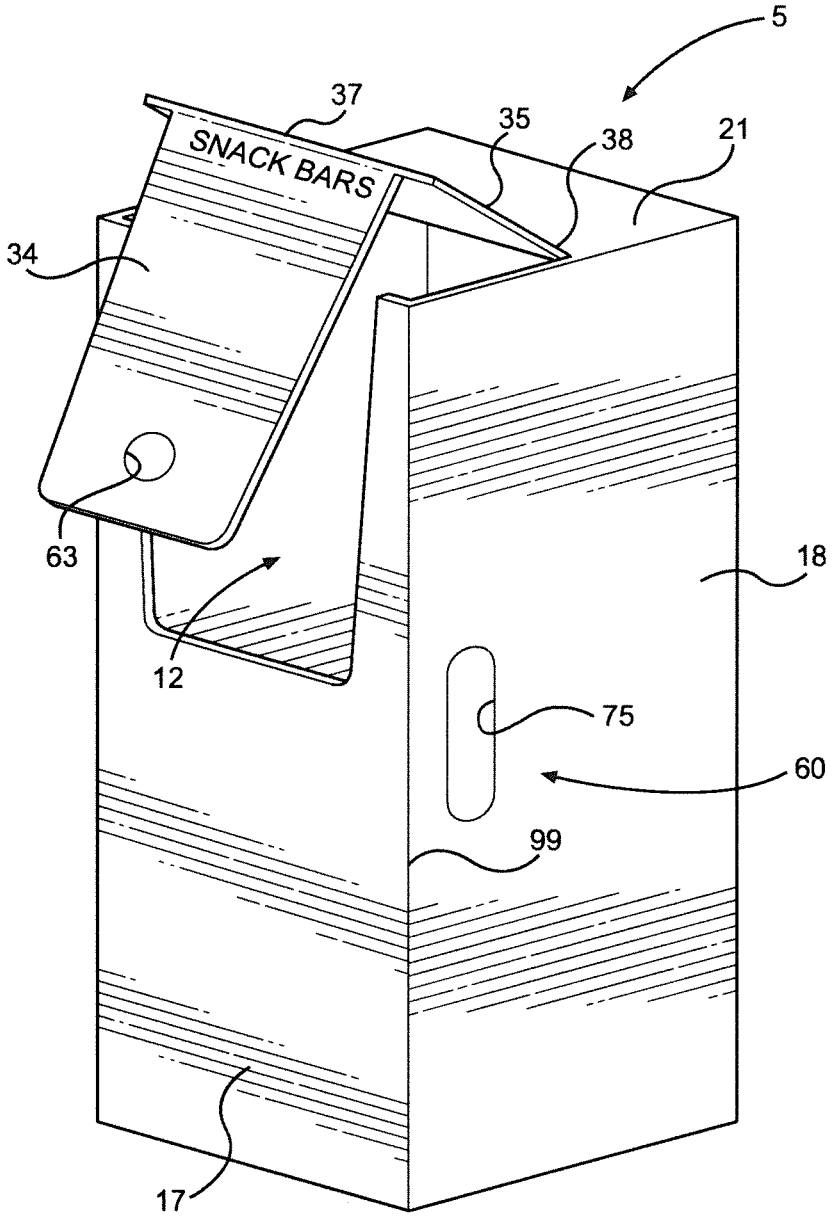
FIG. 5 is a perspective view of another carton handle arrangement in accordance with the invention wherein one of the openings is provided in a carton side panel distinct from the flap.

Also contemplated in connection with the invention is repositioning and re-arranging of first and second openings 63 and 75. For instance, FIG. 4 illustrates an arrangement wherein first opening 63 and second opening 75 are reversed from that of FIG. 3 where first opening 63 is closer than second opening 75 to hinge 38. Therefore, the first or smaller thumb opening 63 is provided in side panel 17 spaced from access opening 50 and the elongated, multi-finger second opening 75 is formed in access flap 30. Certainly, it should be readily apparent that carton 5 can be grasped and maneuvered in a similar manner with this rearrangement of components. FIG. 5 shows another configuration wherein first opening 63 is again provided in access flap 30, while second opening 75 is formed in side panel 18 and preferably extends partially above and partially below a level of access opening 50 as depicted in this figure. With this arrangement, the user's hand 90 would actually extend around a corner 99 of carton 5 for grasping purposes.

Based on the above, it should be readily apparent that the invention provides for establishing a repositionable, enlarged access flap which extends across multiple side panels of a carton, can remain attached to the carton through a hinge and defines, in combination with a second opening formed in another portion of the carton, a handle assembly which can be used to conveniently grasp and lift the carton with a single hand of a user. Although disclosed with reference to preferred embodiments of the invention, is should be readily apparent that various changes and modifications can be made to the invention without departing from the spirit thereof. For instance, although the illustrated embodiments depict certain configurations for access flap 30, it should be recognized that access flap 30 can take various forms. By way of example, access opening 50 could be enlarged by having edge portions 44 and 46 extend directly to the corner established by side panels 17, 18, 21 and 17, 20 and 21 respectively. These reconfigured edge portions 44, 46 could extend linearly from edge portion 45, through multiple angled sections or even through curvilinear portions without departing from the invention.

The invention claimed is:

1. A carton for storing a plurality of products, the carton comprising:

a main body establishing an enclosure with an interior cavity for storing the plurality of products, with the enclosure being formed from a plurality of interconnected panels, the plurality of interconnected panels including a plurality of side panels and first and second end panels which collectively form the main body;

an access flap hingedly connected to the main body and enabling access to the interior cavity, with the access flap including a first portion formed from part of one of the plurality of interconnected panels and a second portion formed from part of a separate one of the plurality of interconnected panels, such that the access flap is formed from and extends across portions of at least two of the plurality of interconnected panels, wherein the second portion of the access flap is hingedly connected to another part of the separate one of the plurality of interconnected panels and the first portion has a free end portion that is remote from where the second portion of the access flap is hingedly connected;

perforations formed in the at least two of the plurality of interconnected panels and extending about all but one section of the access flap; and a handle assembly enabling a user to retain the access flap in a closed position with one hand, the handle assembly being established, at least in part, by first and second openings, with the first opening being formed in the free end portion of the access flap and the second opening being formed in the main body adjacent the access flap, said first and second openings being spaced by a distance enabling the carton to be grasped through the handle assembly with one hand for carrying the carton while retaining the access flap in the closed position.

2. The carton of claim 1, further comprising a plurality of individually wrapped edible food products stored in the interior cavity, with the plurality of individually wrapped edible food products being accessible by a consumer due to the flap.

3. The carton of claim 2, wherein the main body is formed of paperboard or corrugated material.

4. The carton of claim 1, wherein the at least two of the plurality of interconnected panels from which the access flap is formed includes one of the plurality of side panels and one of the first and second end panels.

5. The carton of claim 4, wherein the access flap is connected to the main body of the carton by a living hinge.

6. The carton of claim 1, wherein the access flap is hingedly connected to the main body along the one section in one of the first and second end panels.

7. The carton of claim 1, wherein the first opening is closer than the second opening to where the access flap is hingedly connected to the main body.

8. The carton of claim 1, wherein the first opening is smaller than the second opening and the first opening is configured to receive a thumb of the one hand.

9. The carton of claim 8, wherein the first opening is generally circular and the second opening is generally elliptical.

10. The carton of claim 8, wherein the second opening is formed in the same panel as the first portion of the access flap.

11. The carton of claim 8, wherein the second opening is also formed in a panel adjacent the one of the at least two of the plurality of interconnected panels.

12. A method of carrying a carton, the carton including a main body establishing an enclosure with an interior cavity for storing a plurality of products, with the enclosure being formed from a plurality of interconnected panels, the plurality of interconnected panels including a plurality of side panels and first and second end panels which collectively form the main body, and having an access flap hingedly connected to the main body and enabling access to the interior cavity, with the access flap including a first portion formed from part of one of the plurality of interconnected panels and a second portion formed from part of a separate one of the plurality of interconnected panels, such that the access flap is formed from and extends across portions of at least two of the plurality of interconnected panels, wherein the second portion of the access flap is hingedly connected to another part of the separate one of the plurality of interconnected panels and the first portion has a free end portion that is remote from where the second portion of the access flap is hingedly connected, with perforations formed in the at least two of the plurality of interconnected panels and extending about all but one section of the access flap and the access flap being selectively pivotable between an opened position wherein the access flap is positioned to expose an enlarged access opening through which the plurality of products stored in the carton can be accessed and a closed position wherein the access flap extends across the enlarged access opening, said carton further including a handle assembly enabling a user to retain the access flap in a closed position with one hand, the handle assembly being established, at least in part, by first and second openings, with the first opening being formed in the free end portion of the access flap and the second opening being formed in the main body adjacent the access flap, said first and second openings being spaced by a distance enabling the carton to be grasped through the handle assembly with one hand for carrying the carton while retaining the access flap in the closed position, said method comprising:

grasping the carton with the access flap in the closed position by inserting at least one finger of a hand of the user into the first opening formed in the free end portion of the access flap, remote from where the access flap is pivotable, and at least one other finger of the hand of the user in the second opening formed in the main body adjacent the access flap in order to carry the carton while retaining the access flap in the closed position with the hand of the user.

13. The method of claim 12, wherein the first and second openings are formed in a common one of the plurality of interconnected panels.

14. The method of claim 12, wherein the first and second openings are formed in different ones of the plurality of interconnected panels.

15. The method of claim 12, further comprising:

pivoting the access flap to the closed position by means of a hinge connecting the access flap to one of the plurality of interconnected panels.

16. The method of claim 12, wherein the second opening is formed in the one of the plurality of interconnected panels which is spaced or offset from the access flap.

17. The method of claim 12, wherein inserting the at least one finger of the hand of the user into the first opening formed in the access flap includes inserting a thumb of the user into the first opening.

18. The method of claim 12, further comprising: grasping the carton with the hand of the user extending around a corner of the carton.

* * * * *